US011114035B2

(12) United States Patent
Zhao et al.

(10) Patent No.: US 11,114,035 B2
(45) Date of Patent: Sep. 7, 2021

(54) PIXEL CIRCUIT AND DISPLAY DEVICE

(71) Applicant: KunShan Go-Visionox Opto-Electronics Co., Ltd, Jiangsu (CN)

(72) Inventors: Guohua Zhao, Kunshan (CN); Bingwen Jin, Kunshan (CN); Siming Hu, Kunshan (CN); Zhenzhen Han, Kunshan (CN); Hui Zhu, Kunshan (CN)

(73) Assignee: KunShan Go-Visionox Opto-Electronics Co., Ltd, Kunshan (CN)

( * ) Notice: Subject to any disclaimer, the term of this patent is extended or adjusted under 35 U.S.C. 154(b) by 0 days.

(21) Appl. No.: 17/002,004

(22) Filed: Aug. 25, 2020

(65) Prior Publication Data

US 2020/0388226 A1 Dec. 10, 2020

Related U.S. Application Data

(63) Continuation of application No. PCT/CN2019/088644, filed on May 27, 2019.

(30) Foreign Application Priority Data

Nov. 30, 2018 (CN) ..... 201811458459.0

(51) Int. Cl.
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0426* (2013.01); *G09G 2320/0233* (2013.01)

(58) Field of Classification Search
CPC ..... G09G 3/3258; G09G 3/3233; G09G 2300/0426; G09G 2320/0233
See application file for complete search history.

(56) References Cited

U.S. PATENT DOCUMENTS

2007/0103406 A1* 5/2007 Kim ..... G09G 3/3233 345/76
2017/0148383 A1 5/2017 Kim
2018/0277042 A1 9/2018 Noh et al.

FOREIGN PATENT DOCUMENTS

CN 1835059 A 9/2006
CN 102270425 A 12/2011
(Continued)

OTHER PUBLICATIONS

Examination Report dated Oct. 21, 2019 of corresponding German application No. 201811458459.0; 8 pages.
(Continued)

*Primary Examiner* — Stacy Khoo
(74) *Attorney, Agent, or Firm* — Maier & Maier, PLLC

(57) ABSTRACT

A pixel circuit and a display device. The pixel circuit includes a charging unit, a light-emitting unit and an error compensation unit; a voltage storage terminal of the charging unit is connected to a voltage input terminal of the light-emitting unit; one end of the error compensation unit is connected to the voltage storage terminal of the charging unit, a voltage at the voltage storage terminal of the charging unit is used to determine a magnitude of a current flowing through the light-emitting unit; a control terminal of the error compensation unit is configured to receive a light-emitting control signal which is used to control the light-emitting unit to emit light or stop emitting light, the error compensation unit is configured to lower the voltage at the
(Continued)

voltage storage terminal of the charging unit when the light-emitting control signal controls the light-emitting unit to emit light.

20 Claims, 10 Drawing Sheets

(56) References Cited

FOREIGN PATENT DOCUMENTS

| | | | |
|---|---|---|---|
| CN | 102314829 | A | 1/2012 |
| CN | 102456318 | A | 5/2012 |
| CN | 104778917 | A | 7/2015 |
| CN | 105679236 | A | 6/2016 |
| CN | 107358920 | A | 11/2017 |
| CN | 107644615 | A | 1/2018 |
| CN | 108777132 | A | 11/2018 |
| CN | 109360529 | A | 2/2019 |

OTHER PUBLICATIONS

International Search Report dated Aug. 19, 2019 and Written Opinion in corresponding International application No. PCT/CN2019/088644; 9 pages.

* cited by examiner

PIXEL CIRCUIT AND DISPLAY DEVICE

CROSS-REFERENCE TO RELATED APPLICATIONS

This application is a continuation of the International Application No. PCT/CN2019/088644, filed on May 27, 2019, which claims priority to Chinese Patent Application No. 201811458459.0, filed on Nov. 30, 2018. The disclosures of the aforementioned applications are hereby incorporated by reference in their entireties.

FIELD

The present disclosure relates to the field of display technologies, and particularly to a pixel circuit and a display device.

BACKGROUND

Organic Light-Emitting Diode (OLED) display devices have advantages of self-luminescence, low driving voltage, light and thin, fast response speed and high contrast, and are widely used in the display field.

During manufacturing of an OLED display, due to process reasons, there is usually a problem of uneven parameter threshold voltages for a transistor, which in turn leads to uneven display brightness of the OLED display and decline in display quality. FIG. 1 is a structural schematic diagram of a conventional pixel circuit. The pixel circuit shown in FIG. 1 solves the above problem well.

However, in the pixel circuit shown in FIG. 1, with respect to the transistor device M3 in the charging circuit, at the end of the charging phase and the beginning of the light-emitting phase, the channel charge of M3 is injected into the node P through coupling, an error ΔV1 is introduced to increase the voltage $V_P$ at the node P, further, the current of the light-emitting component OLED in the light-emitting phase is affected. In addition, because M3 in each pixel circuit in the display is a different one, the error ΔV1 is also different, so this error will cause uneven display brightness for the OLED display, and the display quality will decline.

SUMMARY

In order to solve at least one problem mentioned in the background part, the present disclosure provides a pixel circuit and a display device.

A first aspect of an embodiment of the present disclosure provides a pixel circuit, including: a charging unit, or called as a charging circuit; and a light-emitting unit, or called as a light-emitting controlling circuit, a voltage storage terminal of the charging unit is connected to a voltage input terminal of the light-emitting unit; further including: an error compensation unit, or called as an error compensation circuit; where one end of the error compensation unit is connected to the voltage storage terminal of the charging unit, a voltage at the voltage storage terminal of the charging unit is used to determine a magnitude of a current flowing through the light-emitting unit; a control terminal of the error compensation unit is configured to receive a light-emitting control signal which is used to control the light-emitting unit to emit light or stop emitting light; and the error compensation unit is configured to lower the voltage at the voltage storage terminal of the charging unit when the light-emitting control signal controls the light-emitting unit to emit light.

In a feasible embodiment, the pixel circuit further includes: a voltage buffer unit, or called as a voltage buffer circuit; one end of the voltage buffer unit is connected to the voltage storage terminal of the charging unit, and the other end of the voltage buffer unit is connected to a first DC power supply; the first DC power supply provides a negative voltage; the voltage buffer unit is configured to mitigate an amplitude of voltage variation at the voltage storage terminal of the charging unit when the light-emitting control signal controls the light-emitting unit to emit light.

In a feasible embodiment, the light-emitting unit includes a first controllable component, a second controllable component, a third controllable component, and a light-emitting component; the charging unit includes a fourth controllable component, a fifth controllable component and a charging component; where a first end of the first controllable component is connected to a second DC power supply, and a second end of the first controllable component is connected to a first end of the second controllable component; a second end of the second controllable component is connected to a first end of the third controllable component; a second end of the third controllable component is connected to a positive electrode of the light-emitting component; a negative electrode of the light-emitting component is connected to a third DC power supply; the third DC power supply provides a negative voltage; and control terminals of the first controllable component and the third controllable component are configured to receive the light-emitting control signal; a first end of the fifth controllable component is configured to receive a pixel voltage signal, and a second end of the fifth controllable component is connected to the second end of the second controllable component; the first end of the second controllable component is also connected to a first end of the fourth controllable component; a second end of the fourth controllable component is respectively connected to a control terminal of the second controllable component and a first end of the charging component; a second end of the charging component is connected to the second DC power supply; control terminals of the fourth controllable component and the fifth controllable component are configured to receive a charging control signal; and the first end of the charging component is the voltage storage terminal; the charging unit stores the pixel voltage signal to the voltage storage terminal when the charging control signal indicates charging.

In a feasible embodiment, the error compensation unit includes a PMOS (positive channel Metal Oxide Semiconductor) transistor, and a gate of the PMOS transistor is configured to receive the light-emitting control signal, a source of the PMOS transistor is connected to the voltage storage terminal of the charging unit, and a drain of the PMOS transistor is floating.

In a feasible embodiment, the error compensation unit includes a first capacitor, one end of the first capacitor is configured to receive the light-emitting control signal, and the other end of the first capacitor is connected to the voltage storage terminal of the charging unit.

In a feasible embodiment, the error compensation unit includes a resistor, one end of the resistor is configured to receive the light-emitting control signal, and the other end of the resistor is connected to the voltage storage terminal of the charging unit.

In a feasible embodiment, the voltage buffer unit includes a second capacitor; a first end of the second capacitor is connected to the voltage storage terminal of the charging unit, and a second end of the second capacitor is connected to the first DC power supply.

In a feasible embodiment, the light-emitting unit includes: a first controllable component, a second controllable component, a third controllable component and a light-emitting component; the charging unit includes a fourth controllable component, a fifth controllable component and a charging component; where a first end of the first controllable component is connected to a second DC power supply, and a second end of the first controllable component is connected to a first end of the second controllable component; a second end of the second controllable component is connected to a first end of the third controllable component; a second end of the third controllable component is connected to a positive electrode of the light-emitting component; a negative electrode of the light-emitting component is connected to a third DC power supply; the third DC power supply provides a negative voltage; and control terminals of the first controllable component and the third controllable component are configured to receive the light-emitting control signal; a first end of the fifth controllable component is configured to receive a pixel voltage signal, and a second end of the fifth controllable component is connected to the first end of the second controllable component; the second end of the second controllable component is also connected to a first end of the fourth controllable component; a second end of the fourth controllable component is respectively connected to a control terminal of the second controllable component and a first end of the charging component; a second end of the charging component is connected to the second DC power supply; control terminals of the fourth controllable component and the fifth controllable component are configured to receive a charging control signal; and the first end of the charging component is the voltage storage terminal; the charging unit stores the pixel voltage signal to the voltage storage terminal when the charging control signal indicates charging.

In a feasible embodiment, the pixel circuit further includes: a reset unit; one end of the reset unit is connected to the voltage storage terminal of the charging unit, and the other end of the reset unit is connected to the positive electrode of the light-emitting component of the light-emitting unit; a control terminal of the reset unit is configured to receive a reset control signal, and a receiving terminal of the reset unit is connected to a fourth DC power supply; and the fourth DC power supply provides a negative voltage; the reset unit is configured to adjust the voltage at the voltage storage terminal of the charging unit and a voltage at the positive electrode of the light-emitting component according to the fourth DC power supply when the reset control signal controls the reset unit to reset.

A second aspect of the present disclosure provides a pixel circuit, including: a charging unit; a light-emitting unit, a voltage storage terminal of the charging unit is connected to a voltage input terminal of the light-emitting unit; and a voltage buffer unit; one end of the voltage buffer unit is connected to the voltage storage terminal of the charging unit, and a voltage at the voltage storage terminal of the charging unit is used to determine a magnitude of a current flowing through the light-emitting unit; the other end of the voltage buffer unit is connected to a first DC power supply; the first DC power supply provides a negative voltage; the voltage buffer unit is configured to mitigate an amplitude of voltage variation at the voltage storage terminal of the charging unit when the light-emitting control signal controls the light-emitting unit to emit light; the light-emitting control signal is used to control the light-emitting unit to emit light or stop emitting light.

A third aspect of the present disclosure provides a pixel circuit, including: a charging unit and a light-emitting unit; the light-emitting unit includes: a first controllable component, a second controllable component, a third controllable component and a light-emitting component; the charging unit includes a fourth controllable component, a fifth controllable component and a charging component; where a first end of the first controllable component is connected to a second DC power supply, and a second end of the first controllable component is connected to a first end of the second controllable component; a second end of the second controllable component is connected to a first end of the third controllable component; a second end of the third controllable component is connected to a positive electrode of the light-emitting component; a negative electrode of the light-emitting component is connected to a third DC power supply; the third DC power supply provides a negative voltage; and control terminals of the first controllable component and the third controllable component are configured to receive the light-emitting control signal; a first end of the fifth controllable component is configured to receive a pixel voltage signal, and a second end of the fifth controllable component is connected to the second end of the second controllable component; the first end of the second controllable component is also connected to a first end of the fourth controllable component; a second end of the fourth controllable component is respectively connected to a control terminal of the second controllable component and a first end of the charging component; a second end of the charging component is connected to the second DC power supply; control terminals of the fourth controllable component and the fifth controllable component are configured to receive a charging control signal; and the first end of the charging component is the voltage storage terminal; the charging unit stores the pixel voltage signal to the voltage storage terminal when the charging control signal indicates charging.

In a feasible embodiment, the reset unit includes a sixth controllable component and a seventh controllable component, a first end of the sixth controllable component is connected to the voltage storage terminal of the charging unit, and a second end of the sixth controllable component is connected to the fourth DC power supply; a first end of the seventh controllable component is connected to the positive electrode of the light-emitting component, and a second end of the seventh controllable component is connected to the fourth DC power supply; and control terminals of the sixth controllable component and the seventh controllable component are configured to receive the reset control signal.

In a feasible embodiment, the fourth DC power supply is the first DC power supply.

In a feasible embodiment, the fifth controllable component, the second controllable component, the fourth controllable component, and the charging component constitute a charging circuit; the first controllable component, the second controllable component, the third controllable component and the light-emitting component constitute a light-emitting circuit.

A fourth aspect of the present disclosure provides a display panel including N rows of display circuits, where each row of display circuits includes a plurality of pixel circuits in any feasible embodiment as described in the first aspect to the third aspect, the plurality of pixel circuits being arranged in an array; where N is a positive integer greater than 1.

In the display panel, a light-emitting unit in a pixel circuit in the i-th row of display circuits receives the i-th light-emitting control signal; and a control terminal of an error compensation unit in the pixel circuit in the i-th row of display circuits receives the (i+1)-th light-emitting control signal; where i is a positive integer and a value of i is not greater than N.

A fifth aspect of the present disclosure provides a display device, including the display panel.

In the present disclosure, by adding the error compensation unit in the pixel circuit to lower a voltage rise at the voltage input terminal of the light-emitting unit at the end of the charging phase and at the beginning of the light-emitting phase, brightness consistency of the display and display quality can be improved.

The structure of the present disclosure and its other inventive objectives and beneficial effects will be more clearly understood through description of preferred embodiments in conjunction with accompanying drawings.

DETAILED DESCRIPTION

Figure 1:
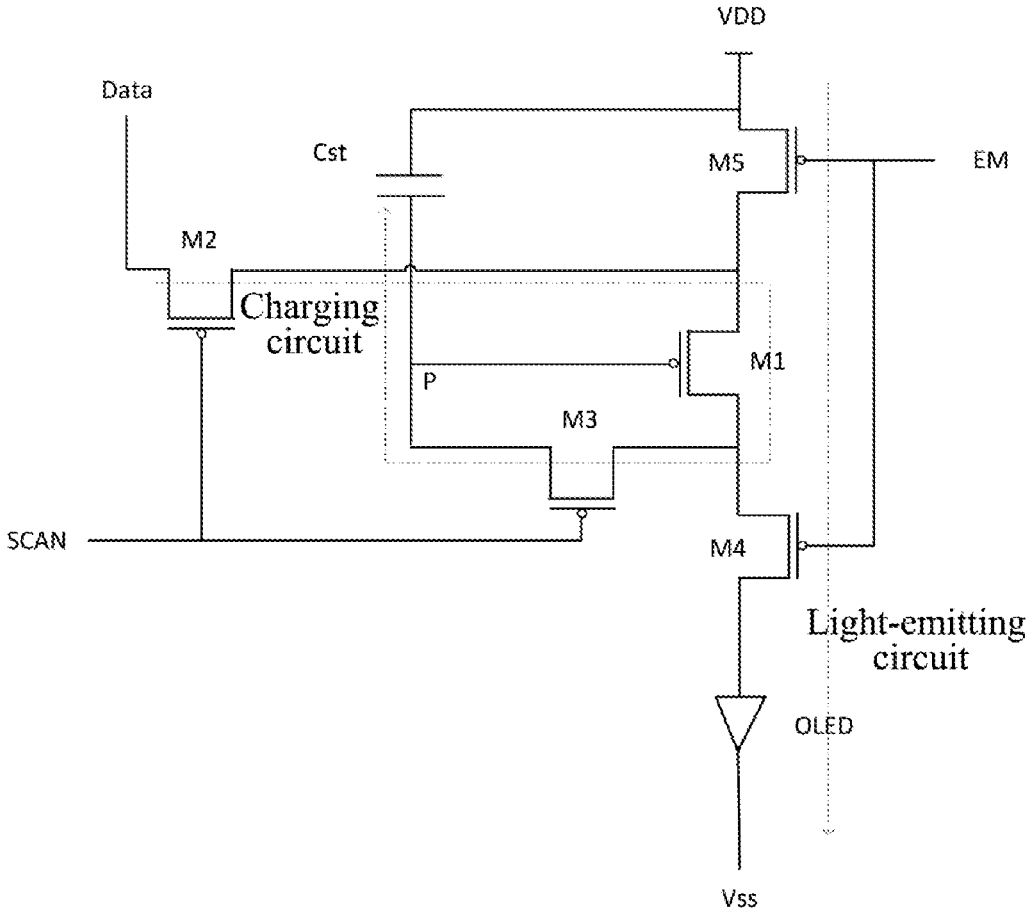
FIG. 1 (Prior art)
FIG. 1 is a structural schematic diagram of a pixel circuit.

In order to describe objectives, technical solutions and advantages of the present disclosure more clearly, the technical solutions in the embodiments of the present disclosure may be described in more details in conjunction with the drawings in the preferred embodiments of the present disclosure. In the drawings, the same or similar reference numerals indicate the same or similar components or components having the same or similar functions. The described embodiments are a part of the embodiments of the present disclosure, but not all the embodiments. The embodiments described below with reference to the drawings are exemplary, and are intended to explain the present disclosure, and shall not be construed as limiting the present disclosure. Based on the embodiments in the present disclosure, all other embodiments obtained by a person of ordinary skill in the art without creative effort should fall into the protection scope of the present disclosure. The embodiments of the present disclosure will be described in detail below with reference to the drawings.

FIG. 1 is a structural schematic diagram of a pixel circuit. Referring to FIG. 1, the pixel circuit includes: transistor devices M1, M2, M3, M4, and M5; a capacitor Cst; and an OLED. Among them, M1, M2, M3 and Cst constitute a charging circuit. When a charging control signal (SCAN signal) is valid, the charging circuit starts to work and is used to store a pixel voltage signal (Data signal) to the capacitor Cst. M1, M4, M5 and the OLED constitute a light-emitting circuit. When the SCAN signal is invalid and the light-emitting control signal (EM signal) is valid, the light-emitting circuit starts to work, and the OLED emits light according to potential across the node P at the connection of the capacitor Cst and M1.

However, with respect to M3 in the charging circuit, at the end of the charging phase and the beginning of the light-emitting phase, the channel charge of M3 is injected into the node P through coupling, an error ΔV1 is introduced to increase the voltage $V_P$ at the node P, further, the current of the OLED in the light-emitting phase is affected. In addition, because M3 in each pixel circuit in the display is a different one, the error ΔV1 is also different, so this error will cause uneven display brightness for the OLED display, and the display quality will decline.

In order to solve the above problems, an embodiment of the present disclosure provides a pixel circuit. The pixel circuit provided in the present disclosure will be described in detail below in conjunction with specific embodiments.

Embodiment 1

Figure 2:
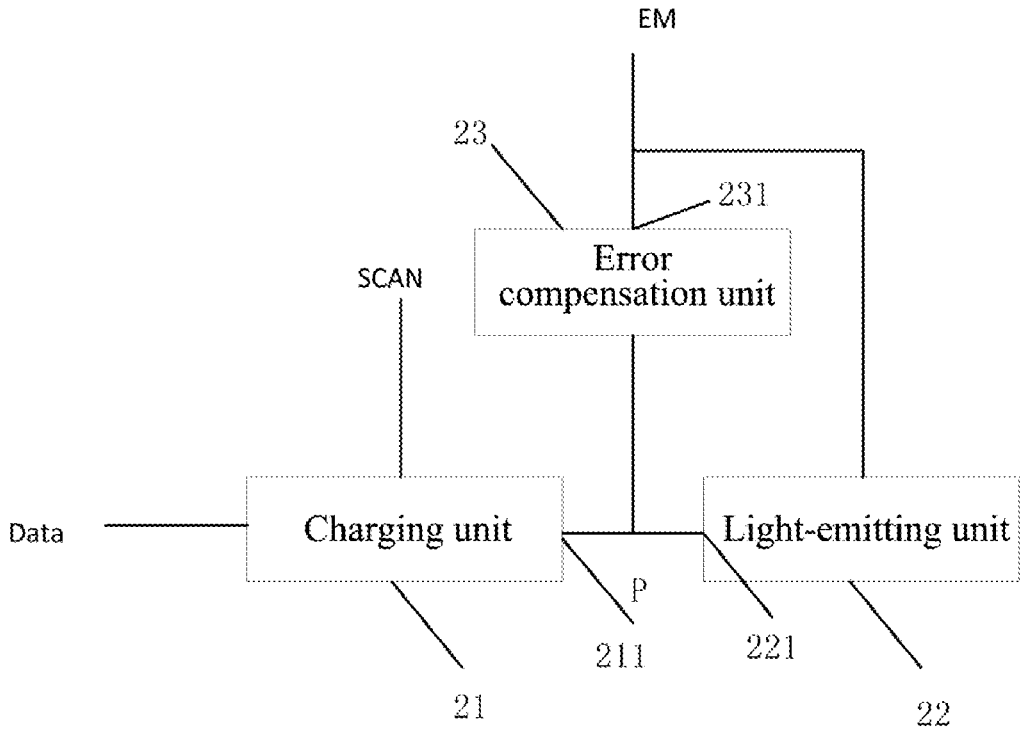
FIG. 2 is a structural schematic diagram of a pixel circuit provided in Embodiment 1 of the present disclosure.

FIG. 2 is a structural schematic diagram of a pixel circuit provided in Embodiment 1 of the present disclosure. Referring to FIG. 2, the pixel circuit provided in the embodiment of the present disclosure includes: a charging unit 21, a light-emitting unit 22, and an error compensation unit 23; where a voltage storage terminal 211 of the charging unit 21 is connected to a voltage input terminal 221 of the light-emitting unit 22; one end of the error compensation unit 23 is connected to the voltage storage terminal 211 of the charging unit 21, and a voltage at the voltage storage terminal 211 of the charging unit 21 is used to determine a magnitude of a current flowing through the light-emitting unit 22; a control terminal 231 of the error compensation unit 23 is configured to receive a light-emitting control signal which is used to control the light-emitting unit 22 to emit light or stop emitting light; the error compensation unit 23 is configured to lower the voltage at the voltage storage terminal 211 of the charging unit 21 when the light-emitting control signal controls the light-emitting unit 22 to emit light.

Exemplarily, as shown in FIG. 2, the pixel circuit provided in this embodiment further includes an error compensation unit 23 on the basis of including the charging unit 21 and the light-emitting unit 22.

The voltage storage terminal 211 of the charging unit 21 is connected to the voltage input terminal 221 of the light-emitting unit 22, and the connection point is marked as P.

The charging unit 21 receives a SCAN signal and a Data signal, and is configured to store the Data signal to the node P when the SCAN signal is valid, and the voltage at the node P is subject to a magnitude of the Data signal. The SCAN signal is used to control the charging unit 21 to start storing the Data signal, and the magnitude of the Data signal indicates values of pixels in the image. The light-emitting unit 22 receives an EM signal, and is configured to determine, according to the voltage at the node P, a magnitude of a current flowing through the light-emitting unit 22 when the EM signal is valid. The EM signal is used to control the light-emitting unit 22 to emit light or stop emitting light.

In the embodiment, one end of the error compensation unit 23 is connected to the node P, the control terminal 231 of the error compensation unit 23 receives the EM signal, and the error compensation unit 23 is configured to lower the voltage at the node P when the EM signal controls the light-emitting unit 22 to emit light.

By adding the error compensation unit 23, at the end of the charging phase and the beginning of the light-emitting phase, an error ΔV2 is introduced at the node P to lower a voltage $V_P$ at the node P, thereby lowering a rise in the voltage $V_P$ at the node P due to an error ΔV1, and mitigating the problem of uneven display brightness of the OLED display and decline in display quality.

In the present disclosure, by adding the error compensation unit in the pixel circuit to lower a voltage rise at the voltage input terminal of the light-emitting unit at the end of the charging phase and at the beginning of the light-emitting phase, brightness consistency of the display and display quality can be improved.

Embodiment 2

Figure 3:
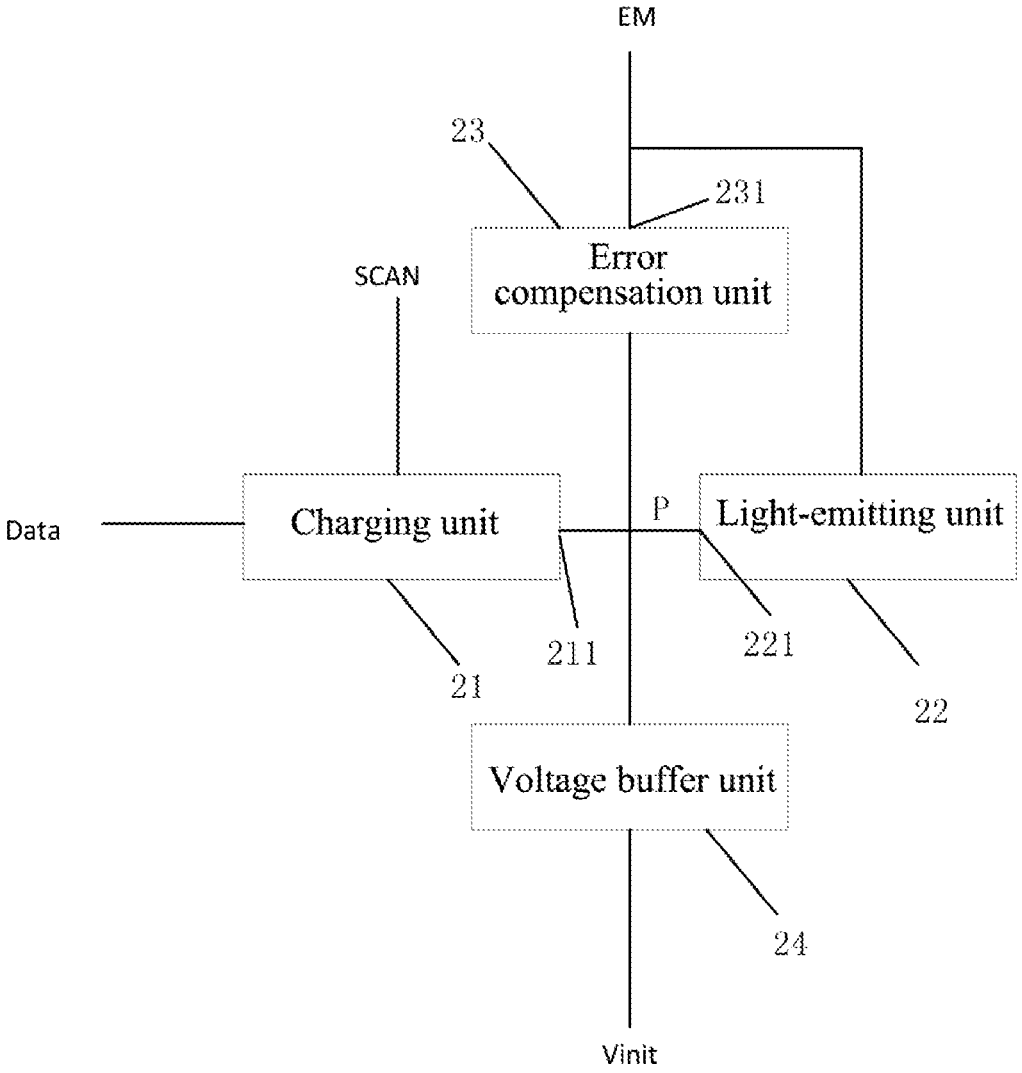
FIG. 3 is a structural schematic diagram of a pixel circuit provided in Embodiment 2 of the present disclosure, in which the pixel circuit further includes a voltage buffer unit.

Based on the embodiment shown in FIG. 2, an embodiment of the present disclosure further provides a pixel circuit. FIG. 3 is a structural schematic diagram of a pixel circuit provided in Embodiment 2 of the present disclosure. As shown in FIG. 3, the pixel circuit further includes: a voltage buffer unit 24;

one end of the voltage buffer unit 24 is connected to a voltage storage terminal 211 of the charging unit 21, and the other end of the voltage buffer unit 24 is connected to a first DC power supply; the first DC power supply provides a negative voltage;

the voltage buffer unit 24 is configured to mitigate an amplitude of voltage variation at the voltage storage terminal 211 of the charging unit 21 when the charging unit 21 ends charging and the light-emitting control signal controls the light-emitting unit 22 to emit light.

Exemplarily, as shown in FIG. 3, the pixel circuit provided in the embodiment further includes a voltage buffer unit 24 based on the embodiment shown in FIG. 2. One end of the voltage buffer unit 24 is connected to the node P, and the other end is connected to a first DC power supply Vinit, where Vinit provides a negative voltage.

Exemplarily, the voltage buffer unit 24 is configured for stabilizing a voltage at the node P, specifically for mitigating an amplitude of voltage variation at the node P when the charging unit 21 ends charging and a light-emitting control signal controls the light-emitting unit 22 to emit light.

According to the pixel circuit provided in the embodiment of the present disclosure, by adding the voltage buffer unit, an amplitude of voltage variation at the node P may be mitigated when the charging unit ends charging and a light-emitting control signal controls the light-emitting unit to emit light, thereby stabilizing potential across the node P.

Embodiment 3

Figure 4:
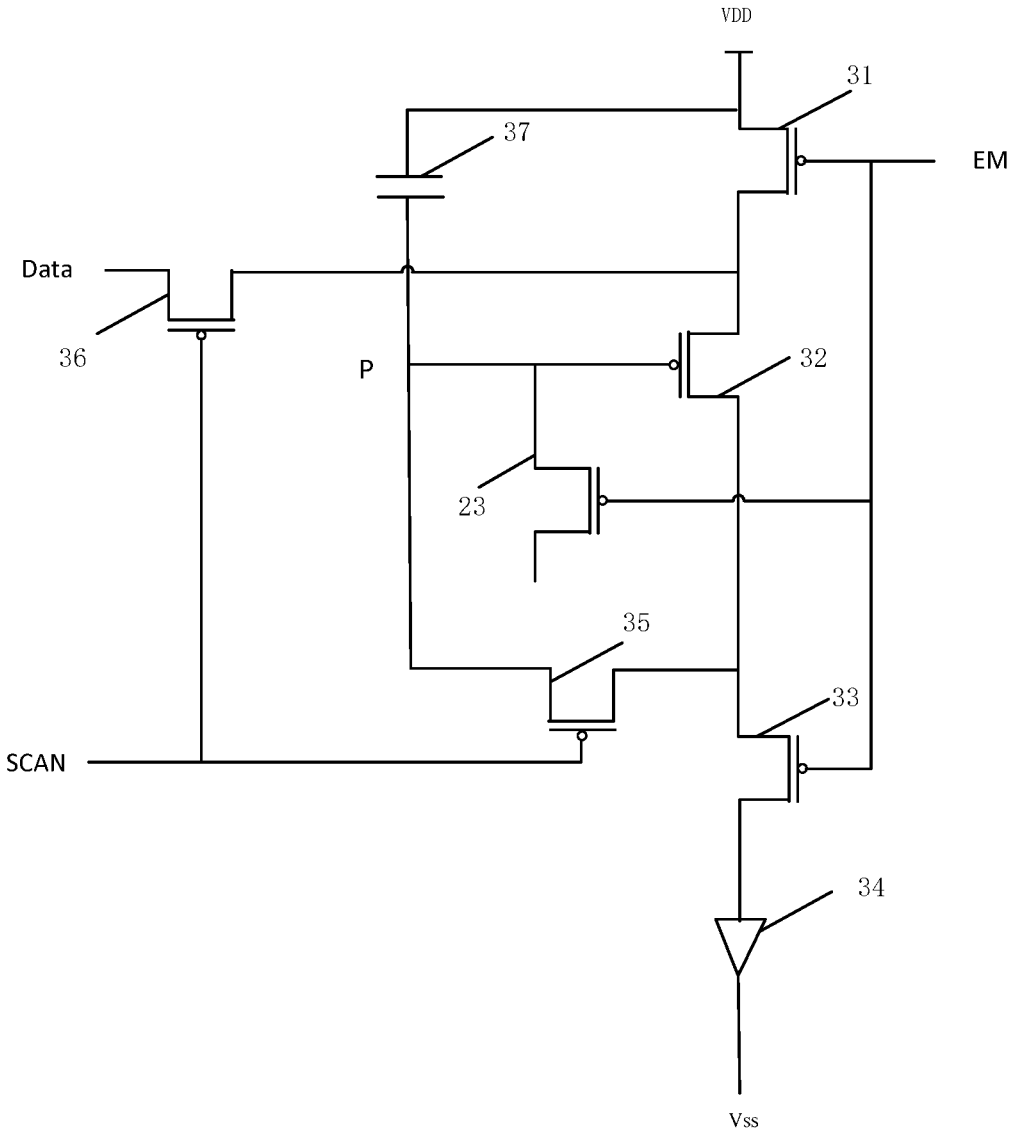
FIG. 4 is a structural schematic diagram of a pixel circuit provided in Embodiment 3 of the present disclosure, in which the light-emitting unit includes a first controllable component, a second controllable component, a third controllable component and a light-emitting component; the charging unit includes a fourth controllable component, a fifth controllable component and a charging component.

Based on the embodiment shown in FIG. 2 or FIG. 3, an embodiment of the present disclosure further provides a pixel circuit. FIG. 4 is a structural schematic diagram of a pixel circuit provided in Embodiment 3 of the present disclosure. Referring to FIG. 4, the pixel circuit includes: a light-emitting unit, a charging unit, and an error compensation unit 23;

where the light-emitting unit includes: a first controllable component 31, a second controllable component 32, a third controllable component 33 and a light-emitting component 34; the charging unit includes: a fourth controllable component 35, a fifth controllable component 36 and a charging component 37;

where a first end of the first controllable component 31 is connected to a second direct current (DC) power supply VDD, and a second end of the first controllable component 31 is connected to a first end of the second controllable component 32; a second end of the second controllable component 32 is connected to a first end of the third controllable component 33; a second end of the third controllable component 33 is connected to a positive electrode of the light-emitting component 34; a negative electrode of the light-emitting component 34 is connected to a third DC power supply Vss; the third DC power supply Vss provides a negative voltage; and control terminals of the first controllable component 31 and the third controllable component 33 are configured to receive the light-emitting control signal EM;

a first end of the fifth controllable component 36 is configured to receive a pixel voltage signal Data, and a second end of the fifth controllable component 36 is connected to the first end of the second controllable component 32; the second end of the second controllable component 32 is also connected to a first end of the fourth controllable component 35; a second end of the fourth controllable component 35 is respectively connected to a control terminal of the second controllable component 32 and a first end of the charging component 37; a second end of the charging component 37 is connected to the second DC power supply VDD; control terminals of the fourth controllable component 35 and the fifth controllable component 36 are configured to receive a charging control signal SCAN; and the first end of the charging component 37 is the voltage storage terminal;

the charging unit stores the pixel voltage signal to the voltage storage terminal when the charging control signal indicates charging.

Exemplarily, as shown in FIG. 4, the fifth controllable component 36, the second controllable component 32, the fourth controllable component 35 and the charging component 37 constitute a charging circuit. When the SCAN signal is valid, the charging circuit works, and the Data signal is written into the node P.

The first controllable component 31, the second controllable component 32, the third controllable component 33, and the light-emitting component 34 constitute a light-emitting circuit. When the EM signal is valid and the SCAN signal is invalid, the light-emitting circuit works and the light-emitting components 34 emits light. The light-emitting effect of the light-emitting component 34 depends on the current flowing through the light-emitting component 34, and the current flowing through the light-emitting component 34 depends on the voltage at the voltage storage terminal, that is, the charging circuit works, and the Data signal at the node P is written.

The light-emitting unit and the charging unit of the pixel circuit provided in the embodiment have a simple structure and low cost.

Embodiment 4

Figure 5:
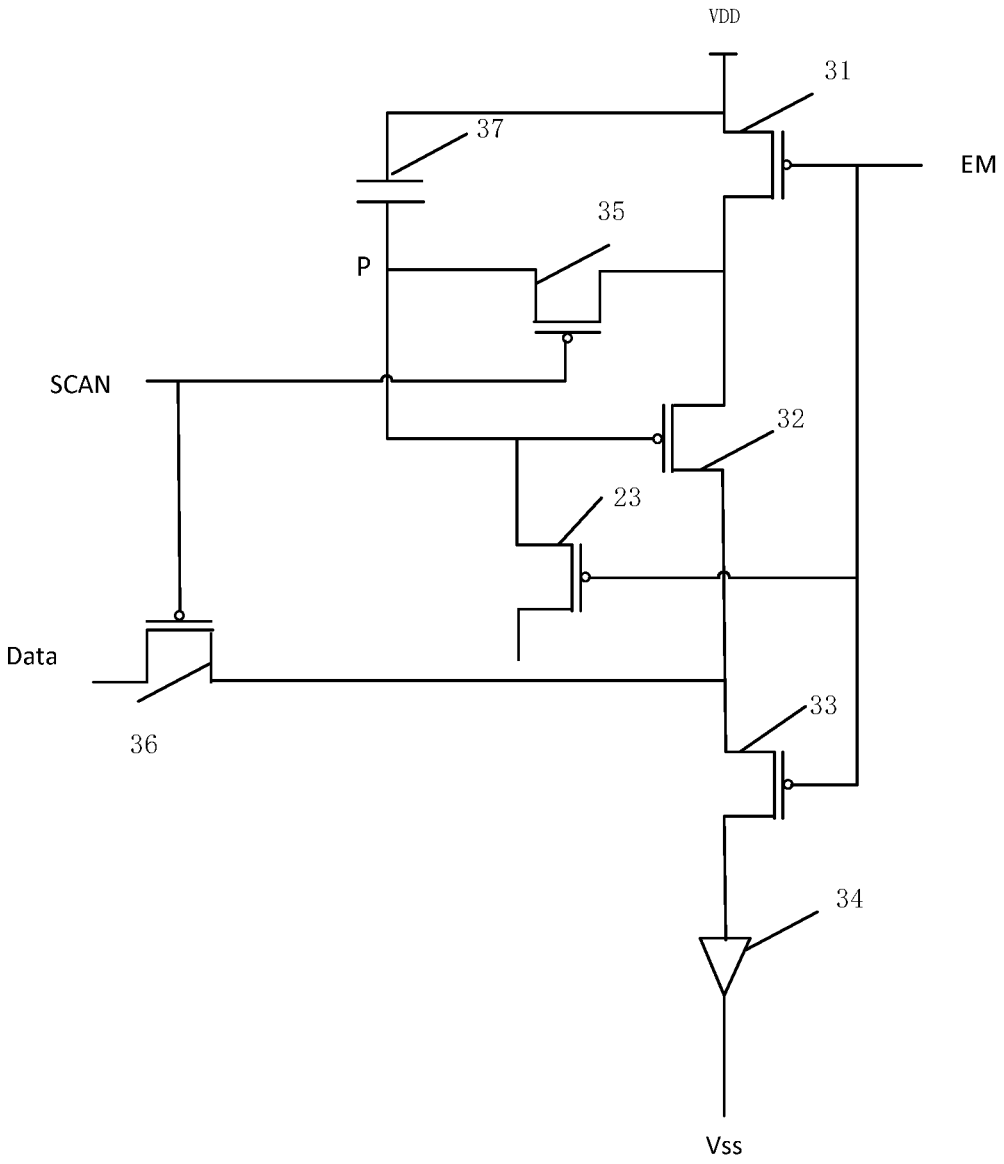
FIG. 5 is a structural schematic diagram of a pixel circuit provided in Embodiment 4 of the present disclosure, in which the connection manner of the charging unit in the pixel circuit is different, specifically a second end of the fifth controllable component is connected to the second end of the second controllable component rather than the first end of the second controllable component.

Based on the embodiment shown in FIG. 2 or FIG. 3, an embodiment of the present disclosure further provides a pixel circuit. FIG. 5 is a structural schematic diagram of a pixel circuit provided in Embodiment 4 of the present disclosure. The charging unit in the pixel circuit provided in this embodiment differs from that in the embodiment shown in FIG. 4 in terms of their connection modes. Referring to FIG. 5, the pixel circuit includes: a light-emitting unit, a charging unit, and an error compensation unit 23;

where the light-emitting unit includes: a first controllable component 31, a second controllable component 32, a third controllable component 33, and a light-emitting component 34; the charging unit includes: a fourth controllable component 35, a fifth controllable component 36, and a charging component 37;

a first end of the first controllable component 31 is connected to a second DC power supply VDD, and a second end of the first controllable component 31 is connected to a first end of the second controllable component 32; a second end of the second controllable component 32 is connected to a first end of the third controllable component 33; a second end of the third controllable component 33 is connected to a positive electrode of the light-emitting component 34; a negative electrode of the light-emitting component 34 is connected to a third DC power supply Vss; the third DC power supply Vss provides a negative voltage; and control terminals of the first controllable component 31 and the third controllable component 33 are configured to receive the light-emitting control signal EM;

a first end of the fifth controllable component 36 is configured to receive a pixel voltage signal Data, and a second end of the fifth controllable component 36 is connected to the second end of the second controllable component 32; the first end of the second controllable component 32 is also connected to a first end of the fourth controllable component 35; a second end of the fourth controllable component 35 is respectively connected to a control terminal of the second controllable component 32 and a first end of the charging component 37; a second end of the charging component 37 is connected to the second DC power supply VDD; control terminals of the fourth controllable component 35 and the fifth controllable component 36 are configured to receive a charging control signal SCAN; and the first end of the charging component 37 is the voltage storage terminal;

the charging unit stores the pixel voltage signal to the voltage storage terminal when the charging control signal indicates charging.

Exemplarily, unlike the embodiment shown in FIG. 4, in this embodiment, the positions of the fourth controllable component 35 and the fifth controllable component 36 are exchanged.

Exemplarily, in the embodiment shown in FIG. 4, when the fourth controllable component 35 is turned off, a current may still exist in the fourth controllable component 35, and T-aging of the fourth controllable component 35 is a difference between potential across the gate and the drain of the fourth controllable component 35, which reduces the leakage current in the fourth controllable component 35 and avoids the voltage drop at the node P. However, the T-aging of the fourth controllable component 35 may generate an effect similar to that of a lightly doped drain LDD structure between the gate and the drain of the second controllable component 32, which may affect the life of the second controllable component 32.

According to the driving method of the pixel circuit provided in this embodiment, by adjusting positions of the fourth controllable component 35 and the fifth controllable component 36 in the charging unit, during the T-aging of the fourth controllable component 35, it can be avoided that an effect similar to that of an LDD structure is generated on the second controllable components 32, thereby increasing the life of the second controllable component 32.

Embodiment 5

Figure 6:
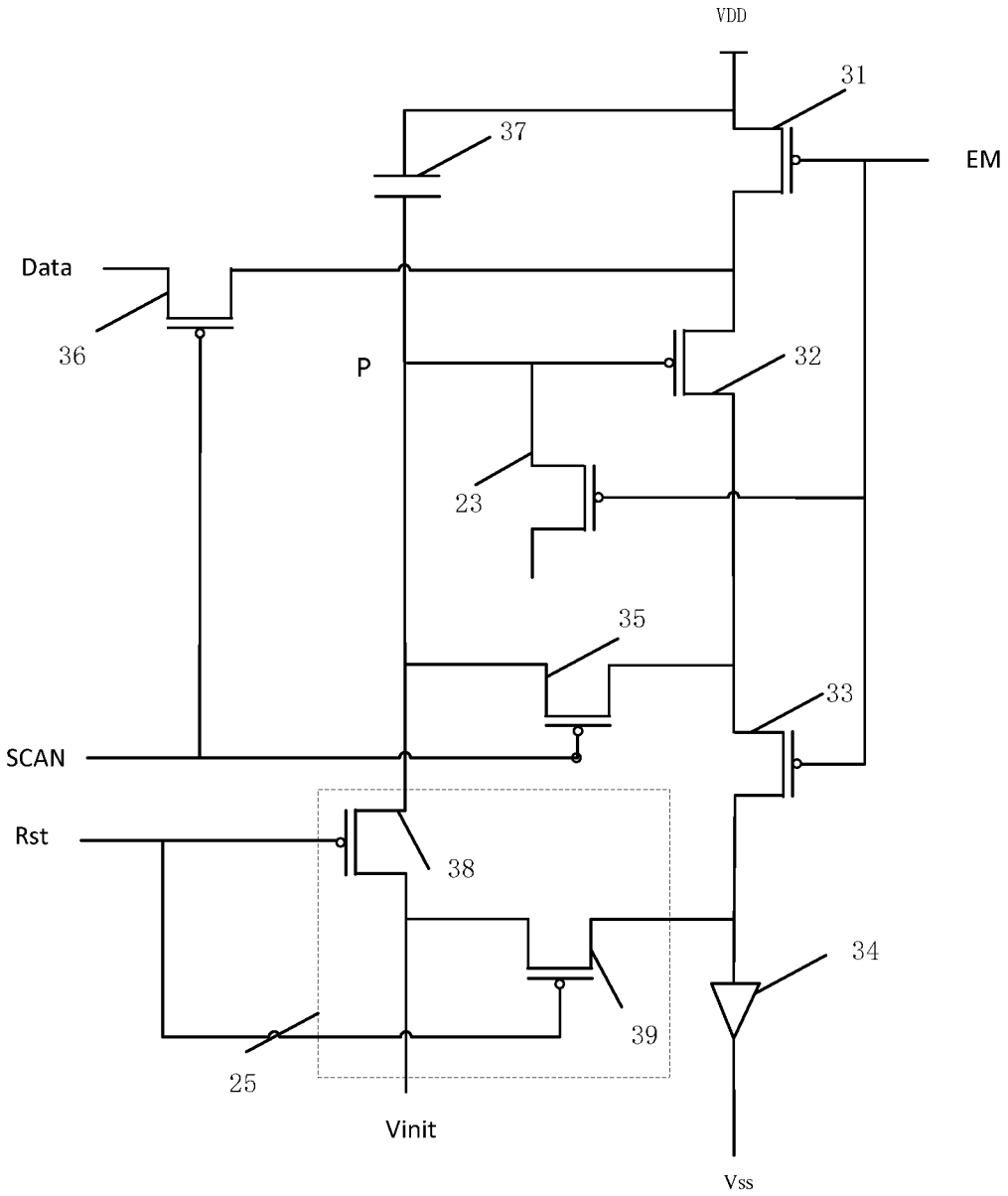
FIG. 6 is a structural schematic diagram of a pixel circuit provided in Embodiment 5 of the present disclosure, in which the pixel circuit further includes a reset unit.

Based on any one of the foregoing embodiments, an embodiment of the present disclosure further provides a pixel circuit. FIG. 6 is a structural schematic diagram of a pixel circuit provided in Embodiment 5 of the present disclosure. Referring to FIG. 6, the pixel circuit further includes a reset unit 25;

where one end of the reset unit 25 is connected to the voltage storage terminal of the charging unit, and the other end of the reset unit 25 is connected to the positive electrode of the light-emitting component 34 of the light-emitting unit; a control terminal of the reset unit 25 is configured to receive a reset control signal Rst, and a receiving terminal of the reset unit 25 is connected to a fourth DC power supply; and the fourth DC power supply provides a negative voltage;

the reset unit 25 is configured to adjust the voltage at the voltage storage terminal of the charging unit and a voltage at the positive electrode of the light-emitting component 34 according to the fourth DC power supply when the reset control signal controls the reset unit 25 to reset.

Exemplarily, as shown in FIG. 6, the pixel circuit further includes a reset unit 25. When the Data signal provides a new voltage, potential across the node P needs to be updated to facilitate the charging unit to write a new Data signal into the node P.

Exemplarily, as shown in FIG. 6, the reset unit 25 includes a sixth controllable component 38 and a seventh controllable component 39, a first end of the sixth controllable component 38 is connected to the voltage storage terminal of the charging unit, and a second end of the sixth controllable component 38 is connected to the fourth DC power supply; a first end of the seventh controllable component 39 is connected to the positive electrode of the light-emitting component 34, and a second end of the seventh controllable component 39 is connected to the fourth DC power supply; and control terminals of the sixth controllable component 38 and the seventh controllable component 39 are configured to receive the reset control signal Rst.

Exemplarily, when the reset control signal Rst is valid, the sixth controllable component 38 and the seventh controllable component 39 transfer, the negative voltage provided by the fourth DC power supply, to the voltage storage terminal of the charging unit and the positive electrode of the light-emitting component 34 so that the voltage stored in the charging unit and the current flowing through the light-emitting unit change with the update of the Data signal.

Exemplarily, the fourth DC power supply in the embodiment may be the first DC power supply Vinit in the foregoing embodiment.

Figure 7:
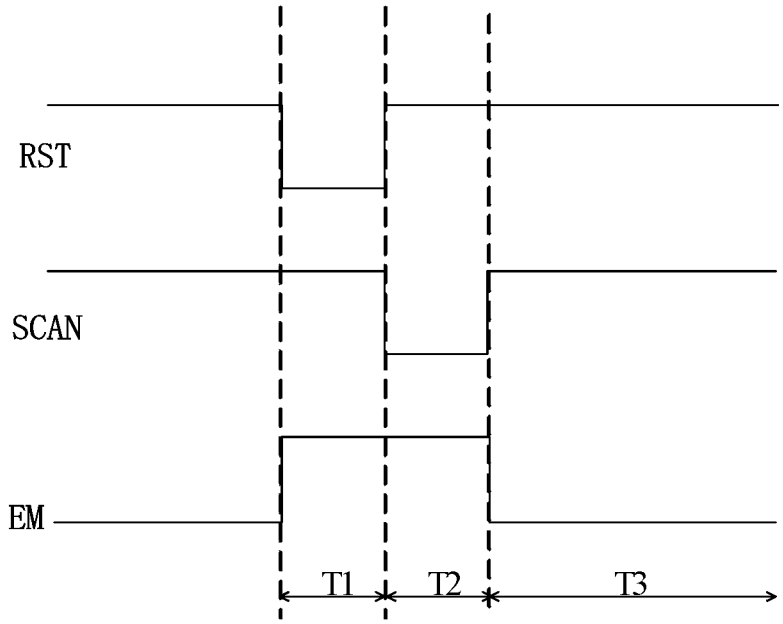
FIG. 7 is a timing schematic diagram of a control signal of a pixel circuit provided in an embodiment of the present disclosure.

Exemplarily, FIG. 7 is a timing schematic diagram of a control signal of a pixel circuit provided in an embodiment of the present disclosure. As shown in FIG. 7, for each frame of image, the operation of the pixel circuit can be simply divided into three phases, i.e. T1, T2, and T3. During T1 (reset phase), the Rst signal is valid, and the SCAN and EM signals are invalid, at this point, the sixth controllable component 38 and the seventh controllable component 39 transfer, to the voltage storage terminal of the charging unit and the positive electrode of the light-emitting component 34, the negative voltage provided by the fourth DC power supply, so that a residual voltage signal of a preceding frame of image does not exist in the pixel circuit. During T2 (charging phase), the SCAN signal is valid, and the Rst and EM signals are invalid, at this point, the fifth controllable component 36, the second controllable component 32, the fourth controllable component 35, and the charging component 37 constitute a charging circuit, and the charging circuit works to write a new frame of Data signal into the node P. During T3 (light-emitting phase), the EM signal is valid, and the Rst and SCAN signals are invalid, at this point, the light-emitting circuit composed of the first controllable component 31, the second controllable component 32, the third controllable component 33 and the light-emitting component 34 emits light, and based on the voltage at the voltage storage terminal during T2, the current flowing through the light-emitting component 34 is determined.

According to the pixel circuit provided in the embodiment of the present disclosure, by adding the reset unit, a residual voltage signal of a preceding frame of image does not exist in the pixel circuit.

Based on any one of the foregoing embodiments, exemplarily, in a feasible embodiment, as shown in FIG. 6, the error compensation unit 23 includes a PMOS transistor, and a gate of the PMOS transistor is configured to receive the light-emitting control signal, a source of the PMOS transistor is connected to the voltage storage terminal of the charging unit, and a drain of the PMOS transistor is floating.

Embodiment 6

Figure 8:
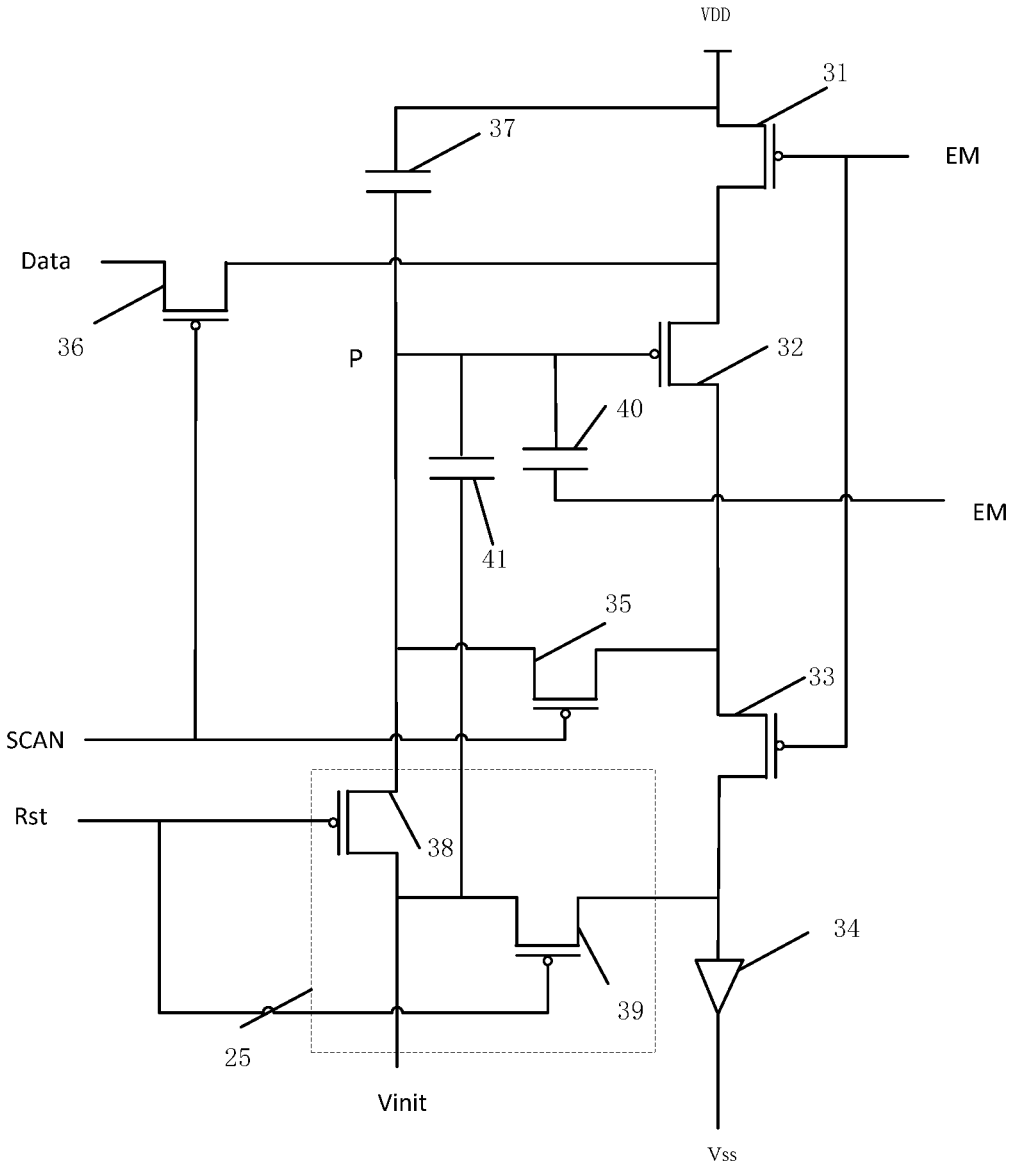
FIG. 8 is a structural schematic diagram of a pixel circuit provided in Embodiment 6 of the present disclosure, in which the error compensation unit includes a first capacitor.

Exemplarily, in a feasible embodiment, FIG. 8 is a structural schematic diagram of a pixel circuit provided in Embodiment 6 of the present disclosure. As shown in FIG. 8, the error compensation unit includes a first capacitor 40, one end of the first capacitor 40 is configured to receive the light-emitting control signal EM, and the other end of the first capacitor 40 is connected to the voltage storage terminal of the charging unit.

Exemplarily, in a feasible embodiment, the error compensation unit includes a resistor, one end of the resistor is configured to receive the light-emitting control signal, and the other end of the resistor is connected to the voltage storage terminal of the charging unit.

The error compensation unit in the above feasible embodiment has a simple structure and low cost.

Exemplarily, on the basis of any one of the foregoing embodiments, as shown in FIG. 8, the voltage buffer unit includes a second capacitor 41;

a first end of the second capacitor 41 is connected to the voltage storage terminal of the charging unit, and a second end of the second capacitor 41 is connected to the first DC power supply Vinit.

Exemplarily, the charging component 37 may be a capacitor. The light-emitting component 34 may be an OLED.

Embodiment 7

Figure 9:
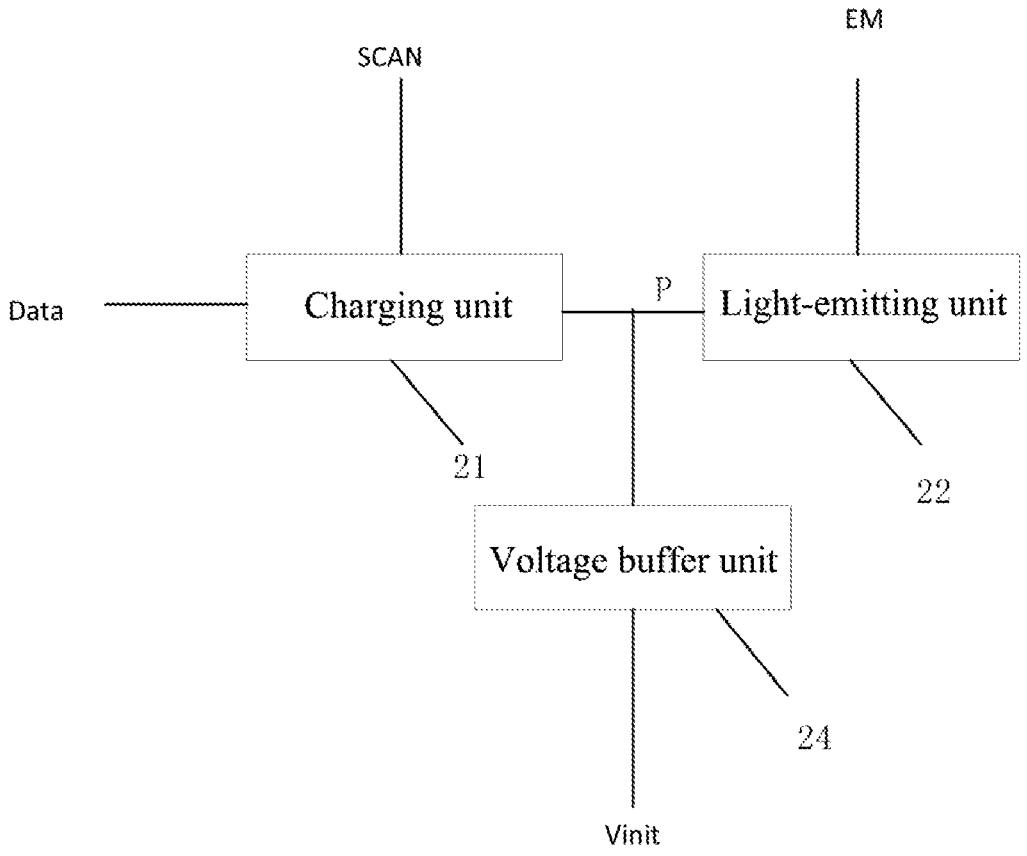
FIG. 9 is a structural schematic diagram of a pixel circuit provided in Embodiment 7 of the present disclosure, in which the pixel circuit includes a charging unit, a light-emitting unit, and a voltage buffer unit.

Another aspect of the embodiment of the present disclosure also provides a pixel circuit. FIG. 9 is a structural schematic diagram of a pixel circuit provided in Embodiment 7 of the present disclosure. As shown in FIG. 9, the pixel circuit includes: a charging unit 21, a light-emitting unit 22, and a voltage buffer unit 24, where a voltage storage terminal of the charging unit 21 is connected to a voltage input terminal of the light-emitting unit 22;

one end of the voltage buffer unit 24 is connected to the voltage storage terminal 211 of the charging unit 21, and a voltage at the voltage storage terminal 211 of the charging unit 21 is used to determine a magnitude of a current flowing through the light-emitting unit;

the other end of the voltage buffer unit 24 is connected to a first DC power supply Vinit; the first DC power supply Vinit provides a negative voltage;

the voltage buffer unit 24 is configured to mitigate an amplitude of voltage variation at the voltage storage terminal of the charging unit 21 when the light-emitting control signal controls the light-emitting unit 22 to emit light; the light-emitting control signal is used to control the light-emitting unit 22 to emit light or stop emitting light.

Exemplarily, the charging unit 21, the light-emitting unit 22 and the voltage buffer unit 24 in this embodiment are the same as the charging unit 21, the light-emitting unit 22 and the voltage buffer unit 24 in the above embodiment in terms of their structures and connection modes, which is not limited in this embodiment.

According to the pixel circuit provided in the embodiment of the present disclosure, by adding the voltage buffer unit, an amplitude of voltage variation at the node P may be mitigated when the charging unit ends charging and the light-emitting control signal controls the light-emitting unit to emit light, thereby stabilizing potential across the node P.

Embodiment 8

Figure 10:
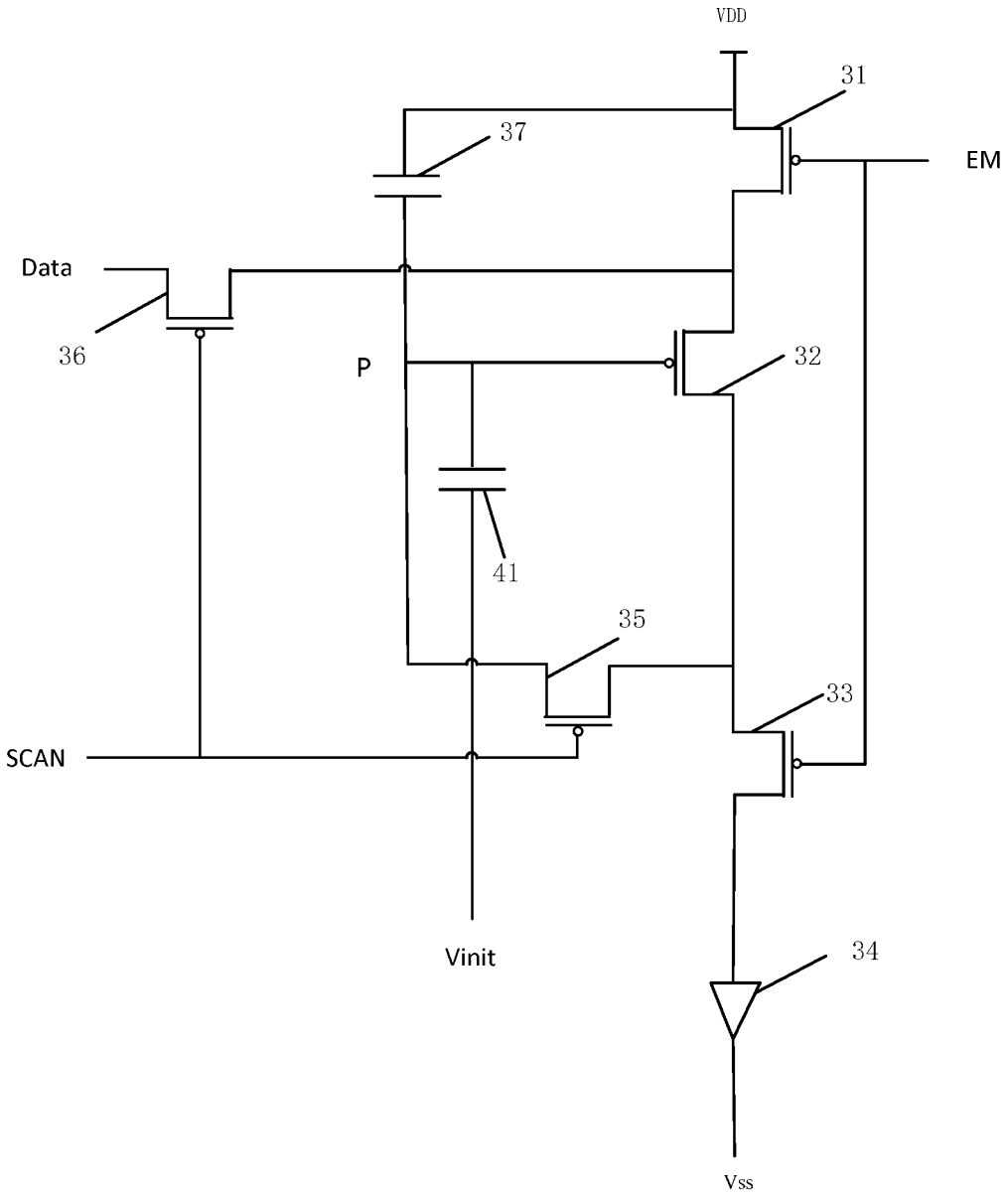
FIG. 10 is a structural schematic diagram of a pixel circuit provided in Embodiment 8 of the present disclosure, in which the voltage buffer unit includes a second capacitor.

In yet another aspect, an embodiment of the present disclosure further provides a pixel circuit. FIG. 10 is a structure schematic diagram of a pixel circuit provided in Embodiment 8 of the present disclosure. As shown in FIG. 10, the pixel circuit includes: a charging unit, a light-emitting unit and a voltage buffer unit.

The light-emitting unit includes: a first controllable component 31, a second controllable component 32, a third controllable component 33, and a light-emitting component 34; the charging unit includes: a fourth controllable component 35, a fifth controllable component 36, and a charging component 37;

a first end of the first controllable component 31 is connected to a second DC power supply VDD, and a second end of the first controllable component 31 is connected to a first end of the second controllable component 32; a second end of the second controllable component 32 is connected to a first end of the third controllable component 33; a second end of the third controllable component 33 is connected to a positive electrode of the light-emitting component 34; a negative electrode of the light-emitting component 34 is connected to a third DC power supply Vss; the third DC power supply Vss provides a negative voltage; and control terminals of the first controllable component 31 and the third controllable component 33 are configured to receive the light-emitting control signal EM;

a first end of the fifth controllable component 36 is configured to receive a pixel voltage signal Data, and a second end of the fifth controllable component 36 is connected to the first end of the second controllable component 32; the second end of the second controllable component 32 is connected to a first end of the fourth controllable component 35; a second end of the fourth controllable component 35 is respectively connected to a control terminal of the second controllable component 32 and a first end of the charging component 37; a second end of the charging component 37 is connected to the second DC power supply VDD; control terminals of the fourth controllable component 35 and the fifth controllable component 36 are configured to receive a charging control signal SCAN; and the first end of the charging component 37 is the voltage storage terminal;

the charging unit stores the pixel voltage signal to the voltage storage terminal when the charging control signal indicates charging.

The voltage buffer unit includes a second capacitor 41;

a first end of the second capacitor 41 is connected to the voltage storage terminal of the charging unit, and a second end of the second capacitor 41 is connected to the first DC power supply Vinit.

Exemplarily, the charging unit, the light-emitting unit and the voltage buffer unit in this embodiment are the same as the charging unit, the light-emitting unit and the voltage buffer unit in the above embodiment in terms of their structures and connection modes, which is not limited in this embodiment.

According to the driving method of the pixel circuit provided in this embodiment, by adjusting positions of the fourth controllable component 35 and the fifth controllable component 36 in the charging unit, during the T-aging of the fourth controllable component 35, it can be avoided that an effect similar to that of an LDD structure is generated on the second controllable components 32, thereby increasing the life of the second controllable component 32.

In yet another aspect, an embodiment of the present disclosure further provides a display panel including N rows of display circuits, where each row of display circuits includes a plurality of pixel circuits described in any one of the foregoing embodiments, the plurality of pixel circuits being arranged in an array; where N is a positive integer greater than 1.

In the display panel, a light-emitting unit in a pixel circuit in the i-th row of display circuits receives the i-th light-emitting control signal; and a control terminal of an error compensation unit in the pixel circuit in the i-th row of display circuits receives the (i+1)-th light-emitting control signal;

where i is a positive integer and a value of i is not greater than N.

The other technical features of the pixel circuit in this embodiment are the same as those in any one of the foregoing embodiments, and the same technical effect may be achieved, which will not be described herein again.

In the display panel provided in the embodiment of the present disclosure, the control terminal of the error compensation unit receives EM signal from a next row of display circuits, which has a better layout effect.

In yet another aspect, an embodiment of the present invention further provides a display device, including the display panel.

The display device provided in this embodiment may be any product or component having a display function, such as a TV, a digital camera, a mobile phone, a tablet computer, a smart watch, an e-book, a navigator, and the like including the pixel circuit described above.

Technical features of the pixel circuit in the display device provided in this embodiment are the same as those of any one of the foregoing embodiments, and the same technical effect may be achieved, which will not be described herein again.

The terms "first", "second", "third", "fourth", etc. (if any) in the description, the claims and the above drawings of the present application are used to distinguish similar objects, but not used to describe a specific order. It should be understood that data used in this way can be interchanged under appropriate circumstances, so that the embodiments of the present application described here can be implemented in an order other than those illustrated or described herein. In addition, the terms "include" and "have" and any variations thereof are intended to cover non-exclusive inclusions, for example, processes, methods, systems, products or devices that contain a series of steps or units may not be limited to those clearly listed steps or units, but may include other steps or units that are not explicitly listed or inherent to these processes, methods, systems, products, or devices.

The foregoing embodiments are only used to illustrate but not to limit the technical solutions of the present disclosure; although the present disclosure has been described in detail with reference to the foregoing embodiments, a person of ordinary skill in the art should understand that the technical solutions set forth in the foregoing embodiments still can be modified, or some or all of the technical features can be equivalently replaced; these modifications or replacements do not deviate the essence of the corresponding technical solutions from the scope of the technical solutions of the embodiments of the present disclosure.

What is claimed is:

1. A pixel circuit, comprising:

a charging unit having a voltage storage terminal;

a light-emitting unit having a voltage input terminal, the voltage storage terminal of the charging unit is connected to the voltage input terminal of the light-emitting unit; and an error compensation unit, one end of the error compensation unit is connected to the voltage storage terminal of the charging unit, a voltage at the voltage storage terminal of the charging unit is used to determine a magnitude of a current flowing through the light-emitting unit, a control terminal of the error compensation unit is configured to receive a light-emitting control signal which is used to control the light-emitting unit to emit light or stop emitting light, and the error compensation unit is configured to lower the voltage at the voltage storage terminal of the charging unit when the light-emitting control signal controls the light-emitting unit to emit light.

2. The pixel circuit according to claim 1, further comprising: a voltage buffer unit;

one end of the voltage buffer unit is connected to the voltage storage terminal of the charging unit, and the other end of the voltage buffer unit is connected to a first direct current power supply, the first direct current power supply provides a negative voltage; and the voltage buffer unit is configured to mitigate an amplitude of voltage variation at the voltage storage terminal of the charging unit when the light-emitting control signal controls the light-emitting unit to emit light.

3. The pixel circuit according to claim 2, wherein the light-emitting unit comprises a first controllable component, a second controllable component, a third controllable component and a light-emitting component, and the charging unit comprises a fourth controllable component, a fifth controllable component and a charging component;

wherein a first end of the first controllable component is connected to a second direct current power supply, and a second end of the first controllable component is connected to a first end of the second controllable component; a second end of the second controllable component is connected to a first end of the third controllable component; a second end of the third controllable component is connected to a positive electrode of the light-emitting component, a negative electrode of the light-emitting component is connected to a third direct current power supply, the third direct current power supply provides a negative voltage; and control terminals of the first controllable component and the third controllable component are configured to receive the light-emitting control signal;

a first end of the fifth controllable component is configured to receive a pixel voltage signal, and a second end of the fifth controllable component is connected to the second end of the second controllable component; the first end of the second controllable component is also connected to a first end of the fourth controllable component, a second end of the fourth controllable component is respectively connected to a control terminal of the second controllable component and a first end of the charging component; a second end of the charging component is connected to the second direct current power supply; control terminals of the fourth controllable component and the fifth controllable component are configured to receive a charging control signal; and the first end of the charging component is the voltage storage terminal;

the charging unit stores the pixel voltage signal to the voltage storage terminal when the charging control signal indicates charging.

4. The pixel circuit according to claim 3, wherein the error compensation unit comprises a positive channel Metal Oxide Semiconductor transistor, and a gate of the positive channel Metal Oxide Semiconductor transistor is configured to receive the light-emitting control signal, a source of the positive channel Metal Oxide Semiconductor transistor is connected to the voltage storage terminal of the charging unit, and a drain of the positive channel Metal Oxide Semiconductor transistor is floating.

5. The pixel circuit according to claim 3, wherein the light-emitting unit comprises a first controllable component, a second controllable component, a third controllable component and a light-emitting component; the charging unit comprises a fourth controllable component, a fifth controllable component and a charging component;

wherein a first end of the first controllable component is connected to a second direct current power supply, and a second end of the first controllable component is connected to a first end of the second controllable component; a second end of the second controllable component is connected to a first end of the third controllable component; a second end of the third controllable component is connected to a positive electrode of the light-emitting component; a negative electrode of the light-emitting component is connected to a third direct current power supply; the third direct current power supply provides a negative voltage; and control terminals of the first controllable component and the third controllable component are configured to receive the light-emitting control signal;

a first end of the fifth controllable component is configured to receive a pixel voltage signal, and a second end of the fifth controllable component is connected to the first end of the second controllable component; the second end of the second controllable component is connected to a first end of the fourth controllable component; a second end of the fourth controllable component is respectively connected to a control terminal of the second controllable component and a first end of the charging component; a second end of the charging component is connected to the second direct current power supply; control terminals of the fourth controllable component and the fifth controllable component are configured to receive a charging control signal; and the first end of the charging component is the voltage storage terminal;

the charging unit stores the pixel voltage signal to the voltage storage terminal when the charging control signal indicates charging.

6. The pixel circuit according to claim 5, further comprising: a reset unit;

one end of the reset unit is connected to the voltage storage terminal of the charging unit, and the other end of the reset unit is connected to a positive electrode of the light-emitting component of the light-emitting unit; a control terminal of the reset unit is configured to receive a reset control signal, and a receiving terminal of the reset unit is connected to a fourth direct current power supply; and the fourth direct current power supply provides a negative voltage;

wherein the reset unit is configured to adjust the voltage at the voltage storage terminal of the charging unit and a voltage at the positive electrode of the light-emitting component according to the fourth direct current power supply when the reset control signal controls the reset unit to reset.

7. The pixel circuit according to claim 6, wherein the reset unit comprises a sixth controllable component and a seventh controllable component, a first end of the sixth controllable component is connected to the voltage storage terminal of the charging unit, and a second end of the sixth controllable component is connected to the fourth direct current power supply; a first end of the seventh controllable component is connected to the positive electrode of the light-emitting component, and a second end of the seventh controllable component is connected to the fourth direct current power supply; and control terminals of the sixth controllable component and the seventh controllable component are configured to receive the reset control signal.

8. The pixel circuit according to claim 6, wherein the fourth direct current power supply is the first direct current power supply.

9. The pixel circuit according to claim 3, further comprising: a reset unit;

one end of the reset unit is connected to the voltage storage terminal of the charging unit, and the other end of the reset unit is connected to the positive electrode of the light-emitting component of the light-emitting unit; a control terminal of the reset unit is configured to receive a reset control signal, and a receiving terminal of the reset unit is connected to a fourth direct current power supply; and the fourth direct current power supply provides a negative voltage;

wherein the reset unit is configured to adjust the voltage at the voltage storage terminal of the charging unit and a voltage at the positive electrode of the light-emitting component according to the fourth direct current power supply when the reset control signal controls the reset unit to reset.

10. The pixel circuit according to claim 3, wherein the fifth controllable component, the second controllable component, the fourth controllable component, and the charging component constitute a charging circuit; the first controllable component, the second controllable component, the third controllable component and the light-emitting component constitute a light-emitting circuit.

11. The pixel circuit according to claim 5, wherein the fifth controllable component, the second controllable component, the fourth controllable component, and the charging component constitute a charging circuit; the first controllable component, the second controllable component, the third controllable component and the light-emitting component constitute a light-emitting circuit.

12. The pixel circuit according to claim 2, wherein the error compensation unit comprises a positive channel Metal Oxide Semiconductor transistor, and a gate of the positive channel Metal Oxide Semiconductor transistor is configured to receive the light-emitting control signal, a source of the positive channel Metal Oxide Semiconductor transistor is connected to the voltage storage terminal of the charging unit, and a drain of the positive channel Metal Oxide Semiconductor transistor is floating.

13. The pixel circuit according to claim 2, wherein the error compensation unit comprises a first capacitor, one end of the first capacitor is configured to receive the light-emitting control signal, and the other end of the first capacitor is connected to the voltage storage terminal of the charging unit.

14. The pixel circuit according to claim 13, wherein the voltage buffer unit comprises a second capacitor;

a first end of the second capacitor is connected to the voltage storage terminal of the charging unit, and a second end of the second capacitor is connected to the first direct current power supply.

15. The pixel circuit according to claim 1, wherein the error compensation unit comprises a positive channel Metal Oxide Semiconductor transistor, and a gate of the positive channel Metal Oxide Semiconductor transistor is configured to receive the light-emitting control signal, a source of the positive channel Metal Oxide Semiconductor transistor is connected to the voltage storage terminal of the charging unit, and a drain of the positive channel Metal Oxide Semiconductor transistor is floating.

16. The pixel circuit according to claim 1, wherein the error compensation unit comprises a first capacitor, one end of the first capacitor is configured to receive the light-emitting control signal, and the other end of the first capacitor is connected to the voltage storage terminal of the charging unit.

17. The pixel circuit according to claim 1, wherein the error compensation unit comprises a resistor, one end of the resistor is configured to receive the light-emitting control signal, and the other end of the resistor is connected to the voltage storage terminal of the charging unit.

18. A display panel, comprising N rows of display circuits, wherein each row of display circuits comprises a plurality of pixel circuits according to claim 1, the plurality of pixel circuits being arranged in an array; wherein N is a positive integer greater than 1.

19. The display panel according to claim 1, wherein a light-emitting unit in a pixel circuit in an i-th row of display circuits receives an i-th light-emitting control signal; and a control terminal of an error compensation unit in the pixel circuit in the i-th row of display circuits receives an (i+1)-th light-emitting control signal;

wherein i is a positive integer and a value of i is not greater than N.

20. A display device, comprising the display panel according to claim 18.

* * * * *